United States Patent [19]

Cross

[11] 4,143,847

[45] Mar. 13, 1979

[54] SNAP LOCKING, SLANT DISPLAY SUPPORT EASEL AND METHOD OF MAKING THE SAME

[76] Inventor: Carroll N. Cross, Rte. 2, Box 741, Maitland, Fla. 32751

[21] Appl. No.: 763,512

[22] Filed: Jan. 28, 1977

[51] Int. Cl.[2] ..... A47B 97/04

[52] U.S. Cl. ..... 248/459; 40/120; 281/15 B

[58] Field of Search ..... 40/120, 121, 124.1; 206/45.21, 45.22, 45.25, 45.26, 45.27, 45.29, 45.3; 248/459, 174, 150, 152; 281/15 B

[56] References Cited

U.S. PATENT DOCUMENTS

| | | | |
|---|---|---|---|
| 2,726,835 | 12/1955 | Hummel | 248/459 |
| 3,013,359 | 12/1961 | Cross et al. | 40/120 X |
| 3,049,324 | 8/1962 | Paschal | 248/459 |
| 3,305,205 | 2/1967 | Frankl | 248/459 |
| 3,305,206 | 2/1967 | Nichols | 248/459 |
| 3,370,368 | 2/1968 | Paschal | 248/459 X |
| 3,580,536 | 5/1971 | Nichols | 248/459 |

FOREIGN PATENT DOCUMENTS

| | | | |
|---|---|---|---|
| 950434 | 7/1974 | Canada | 248/459 |

*Primary Examiner*—Lawrence J. Staab
*Attorney, Agent, or Firm*—Jesse C. Bowyer

[57] ABSTRACT

There are disclosed structures capable of being formed from hitherto non-useable thin materials for easel supports which are initially produced in flat shipping form, but which can be erected into slant surface display easels and mounts in which the structures are snap locked into an operative position with the parts thereof held under a selectable tension, with upper vertical face-to-face contacting display subpanels which are attached to each other at the top hinge bend line therebetween only, with the upper rear display subpanel having struck out tongue portions which are stapled to the lower slanting front display subpanel under selectable tension to produce a rigid snap-locked easel display and mount. Alternative structures are described, as is the method of using one or more staples for fixedly positioning by passing them through the slant support lower subpanel and the struck-out tongues and a calendar memo pad or the like carried by the subpanel, subsequent to printing and die scoring and partial folding.

10 Claims, 10 Drawing Figures

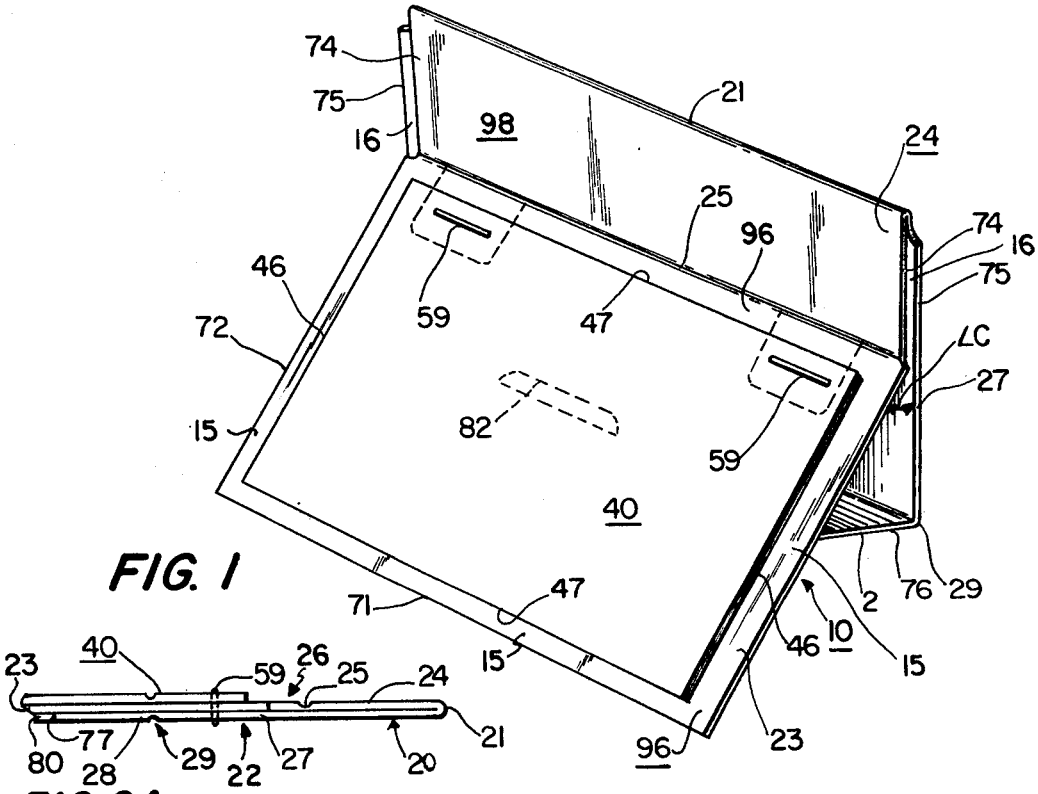
FIG. 1
FIG. 2A
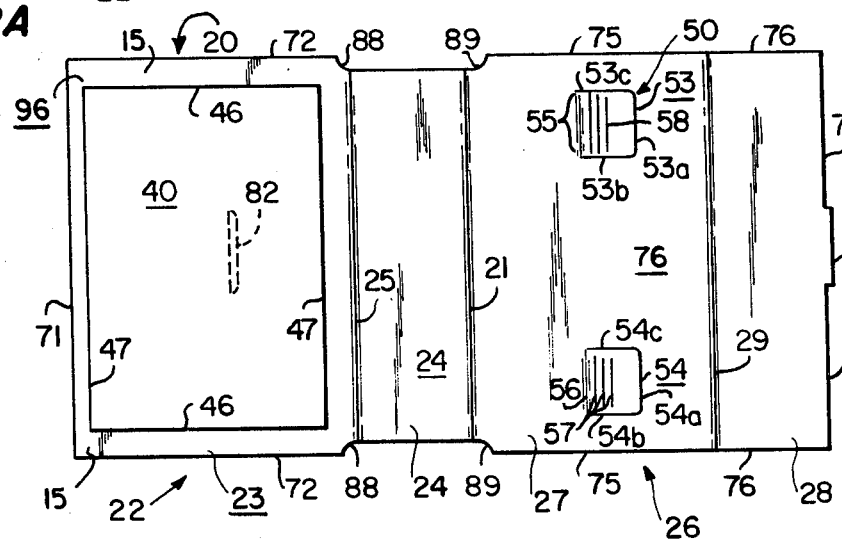
FIG. 2
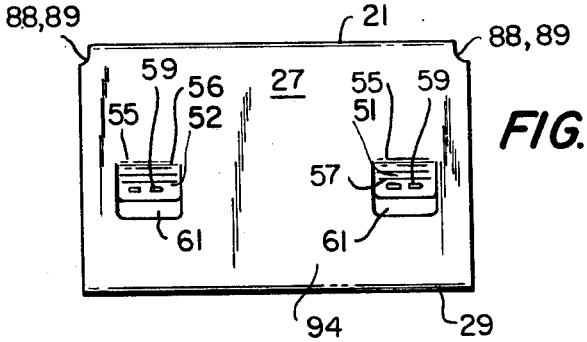
FIG. 4
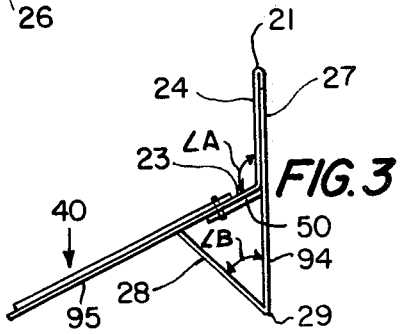
FIG. 3

SNAP LOCKING, SLANT DISPLAY SUPPORT EASEL AND METHOD OF MAKING THE SAME

BRIEF SUMMARY OF THE INVENTION AND BACKGROUND PERTINENT ART

There have been patented and manufactured ever increasing numbers of inexpensive slant-support display easels in recent years.

Basically these consist of a means for positioning a slanting display or writing surface having easel support means. Usually the structure incorporates one or more vertical panels for displaying advertisements, slogans, logos, calendars or the like.

Unlike wall-mounted display structures which can be attached to a solid vertical supporting surface and hence can be readily used as a writing surface, the slant-mount easels must be able to provide adequate support by their own inherent structural details, when slidably or loosely placed upon a planar support surface, such as a desk or counter top, so as to bear the pressure of writing thereon.

In the past most of the art pertaining to such structures have been formed of relatively thick, substantially inflexible cardboard stock, with or without plastic facing layers. Such structures generally use a relatively complex tongue and slot means to maintain the easel in operative position and rely on the strength of the materials and their thickness to provide stability during use.

Economy makes essential structures which may be shipped in a substantially flat form and thereafter have the easel mount moved into operative position.

Illustrative of such prior art are the following patents:

U.S. Pat. No. 2,355,706 to Cross
U.S. Pat. No. 2,750,698 to Nichols
U.S. Pat. No. 3,787,853 to Nichols
U.S. Pat. No. 2,798,322 to Nichols
U.S. Pat. No. 2,825,516 to Cross
U.S. Pat. No. 2,831,285 to Cross
U.S. Pat. No. *2,916,242 to Cross et al
U.S. Pat. No. 2,926,441 to Cross
U.S. Pat. No. *2,954,625 to Nichols
U.S. Pat. No. 2,958,968 to Nichols
U.S. Pat. No. 2,960,783 to Nichols
U.S. Pat. No. 3,021,631 to Cross
U.S. Pat. No. 3,067,652 to Cross
U.S. Pat. No. 3,068,139 to Cross
U.S. Pat. No. *3,305,206 to Nichols
U.S. Pat. No. *3,580,536 to Nichols Of the above, while all are easel mounted, the most pertinent are those marked with an asterisk, in that the structures disclosed therein have the slanting display support surface positioned at a small acute angle relative to their planar supporting environment, because such articles are more easy to use as writing and display surfaces. However, this very property of facile use causes a requirement of an ability by such structures to withstand greater and more frequently applied writing pressure.

While in theory this art problem could be solved by a choice of thick, strong material, such articles are generally used as giveaway promotional calendars, desk memo pads and the like, and hence must be inexpensive. The cost of sufficiently thick rigid structures to provide such proper easel mounts has become intolerable from a marketing standpoint.

Therefore, the art has turned to a search for new structures which can be manufactured with a minimum number of steps and still provide an erectable rigid satisfactory structure using thin, inexpensive materials.

The present invention accomplishes these desired results by novel means which rely on the snap locking of thin materials into operative slant-support mounts by structures more simple, more inexpensive and more strong than the structures described and claimed in the above asterisked patents. Thus, Cross et al. U.S. Pat. No. 2,916,242 uses a plurality of multiple, relatively thick cardboard or the like layers hingedly connected panels with a slot and tongue snap-locking means whose cost is much greater than that of the present invention. Nichols U.S. Pat. No. 2,954,625 is similarly prohibitively expensive. This patent is also illustrative of a further difficulty of using such slant-top easel display mounts; where a tongue and slot connection is used with thick cardboard or the like, repeated locking and unlocking causes the material to become dog-eared or frayed and to lose resiliency at the coacting locking means.

In Nichols U.S. Pat. No. 3,305,206 the structures rely upon an abutment layer to tension the easel in operative position and this requires a substantial, expensive thickness, or the panels will not be maintained in their snap-lock original positions, because there will will not then be an effective snap-lock operative position attainable with thin layered materials which lack both rigidity and sufficient the requisite edge abutment stops. Similar problems are presented by the structures of Nichols U.S. Pat. No. 3,580,536 since the materials which must be used therein require inherent rigidity and resistance to flexure during snap-lock erection and during use, in order to be operative.

This causes a locking tension which will be variable with continued use as well as relatively thick expensive materials.

Also, all of these prior art structures require pre-shaping or pre-stitching of a memo or calendar pad to the slant support surface, since this joining operation cannot be performed after flats are printed and folded for shipment.

It is to be noted that the ability to use the inherent resiliency of paperboard or the like has been long recognized and used, as shown in Larkin U.S. Pat. No. 1,990,739, but this resiliency cannot be maintained uniform during operation, because such properties have changed during repeated use by the prior art devices.

It is therefore the principal object of this invention to provide thin inexpensive material to form snap-lock slant board easels having greater tension, longer lasting uniform tension, and readily preselectable tension to cause retention of the snap lock mount structure, while enabling manufacture with a single stapling step which can be performed after the panels are completely printed and folded-over.

It is a further object to eliminate the use of glue or adhesive to maintain tension of panel to panel positioning to eliminate the gradual debilitating effect of the passage of time on all adhesive joints.

The combined simplicity and rigidity of the thin layered slant board supports of the invention will be more readily appreciated by reference to the accompanying figures of the drawing and to the detailed description and appended claims.

BRIEF DESCRIPTION OF THE DRAWINGS

FIG. 1 is a view in perspective of a preferred embodiment of a snap locking, slant display support easel embodying the present invention and showing the display support in unfolded operative position.

FIG. 2 is a topview of a flat blank which has been die scored, printed and is ready for folding and stapling for shipping.

FIG. 2A is a side elevation of a portion of the folded-over blank of FIG. 2 after the stapling together of a pad layer, the supporting subpanel therefor and a second subpanel in face-to-face relation with each positioned stable holding together said pad and subpanels simultaneously.

FIG. 3 is a side end vertical view of the structure of FIG. 1, on a reduced scale.

FIG. 4 is an elevational view of the back of the device when in operative position.

DETAILED DESCRIPTION OF THE INVENTION

Figure 5:
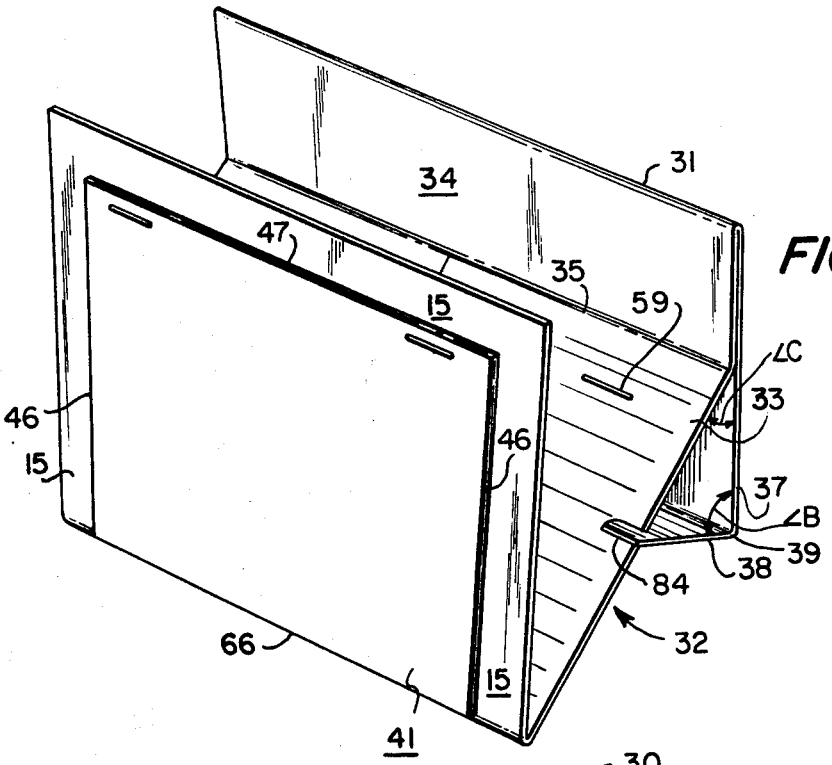
FIG. 5 is a perspective view, similar to FIG. 1, of a modification of the structures of the invention.

As described briefly above, the present invention provides a simple, inexpensive easel mount, particularly for slant-top display mounts.

The structures described herein enable use of thin, relatively inexpensive stock material to attain increased strength of shape retention without using any additional materials to produce this result, but, instead using less material.

Referring to the drawings, the snap-lock easel mount 20 is formed from a flat which is die-cut to produce the initial structure shown in FIG. 2.

Each easel flat 20 is formed basically of a first panel 22 and a second panel 26. These have adjacently positioned upper edges which are connected at a bendable area 21, preferably comprising a flexible hinge joining the top parallel edges of first and second panels 22 and 26. The area 21 may be a score line or may be partially score cut.

Both panels 22 and 26 are preferably substantially rectangular, having the same width; i.e., the distance between side edges 72, 72 of panel 22 being substantially the same as that between the sides 76,76, of panel 26.

Each of these panels is formed with upper and lower subpanels. Thus, first panel 22 is divided into a first lower subpanel 23 and a first upper subpanel 24 at a bendable transverse hinge area or score or compression line 25, so that bending of the upper subpanel 24 relatively to the lower subpanel at the transverse compression or hinge area 25 will rotate these two subpanels about the line 25 as an axis to cause said subpanels to be relatively angularly disposed with the upper subpanel 24 rising substantially vertically, so that the front surface 98 thereof may form an advertising or decorative panel. The angle between the substantially vertical plane of first upper subpanel 24 and first lower subpanel 23 is, as shown at angle A, in FIG. 3, greater than 90 degrees, so that this lower subpanel slants downward from the score or compression line 25 to form a slant top display support surface 96 for calendars, memo pads, order forms or the like, indicated at 40. It is, therefore, designed so that a user would or could write thereon. This causes downward pressure on the upper surface of the lower subpanel 23 tending to push it downward.

The forward transverse edge 71 of said first lower subpanel 23 is substantially straight to contact any planar supporting surface for the mount across the entire front edge.

If this easel mount were to be used without some bracing means, then the lower first subpanel 23 would bow or break.

In the past there have been used many means to provide such extra support, including providing a second upper substantially vertical subpanel, which is glued or adhesively joined to said first upper subpanel.

While this can provide support it can do so only so long as the glue line holds, and all downward pressures on subpanels 23 and 24 tend to weaken the glue or adhesive union.

In the present structure the upper first and upper second subpanels are only joined by means such as a flexible hinge only at their upper transverse edges, so that they are positioned in substantially coplanar face-to-face slideably contacting relation. Since the panel materials are thin, this prevents uneven stresses and allows slight sliding between the upper first and second subpanels.

The rearmost vertical upper subpanel 27 has a length between its top edge 18 at flexible hinge or compression line 21 and the bottom edge 29 thereof which is substantially greater than the length of front upper subpanel 24, so that second upper subpanel 27 extends downwardly considerably beyond bend line 25. At bend area 29, which may be a compression formed flexible hinge, a second lower subpanel 28 is bent rotatably about transverse hinge line 29 out of the vertical plane of upper second subpanel 27 at an angle B of less than 90 degrees, so that panel 28 extends forwardly and upwardly toward the under surface 95 of slant support first lower panel 23.

The rear surface 94 of second upper subpanel 27 may also carrying advertising or other indicia.

By making the score or bend line 29 extend transversely from opposite edges 75,75 and 76,76 of the subpanels 27 and 28 there is formed an edge which can contact a planar supporting surface uninterruptedly across a wide area, i.e. across the entire panelboard width, so as to minimize uneveness in stresses transversely.

In order to rotatably fix the second lower subpanel 28 in a fixed angular position relative to first lower subpanel 23, the outer edge 77 of this subpanel is adapted to bear on the underside of subpanel 23 across substantially the entire width thereof, thus providing edge contact uniform transverse support except at the small area occupied by extending projection 80 which, after the bending at 29, positions the panels fixedly by coaction with slot or slit 82 formed through, or cut into the lower front subpanel 23, thus maximizing contact support.

To allow the above described frictional face-to-face contact between the upper subpanels without resorting to the use of joining means such as glue there-between, the present invention teaches the use of at least one, or more tongue elements 50,50 and preferably a plurality of at least two tongue line elements 53, 54 die cut from the second upper subpanel except at the transverse bases 56, 56 thereof leaving separated edges except at the uncut base bendable areas 55, 55.

While shown as substantially rectangular with side cut free edges 53*b*, 53*c* and 54*b* and 54*c* and end cut free edges 53*a* and 54*a*, the shape of the tongues may be semicircular or otherwise shaped, so long as they perform their intended function.

As shown, these tongues have selectably formed transverse score or bend lines 57, 57 and 58, 58 any one of which may be positioned and selected to form the axis about which these tongues are rotated, as shown at angle C, out of the vertical plane of second upper subpanel 27 to extend parallel to and in face-to-face contact with the undersurface 95 of first lower subpanel member 23 so that they reinforce the angle A juncture between upper and lower front subpanels 23 and 24.

To hold these subpanels fixedly relatively to each other joining means such as a stitch or staple is used. Preferably there is a staple 59 for each tongue, the staple being preferrably positioned medially relative to the front and rear edges of the tongue and relative to the center thereof from side to side.

These staples are applied after the flat 20 has been folded-over as shown in FIG. 2A with the two panels 22 and 26 in face-to-face relation. After a calendar or memo pad or the like 40 has been placed on the top surface 96 of first lower subpanel 23, staples 59, 59 one for each tongue, 50 of the upper rear subpanel 27 are driven through the tongue and through subpanel 23 and through pad 40 by driving the same therethrough from above in known stapling fashion.

Thus these staples perform the dual function of fixedly securing the pad 40 to the slanting subpanel 23 and of joining subpanels 23 and 27, and hence, panels 22 and 26 in fixed relation wherein this staple joint exerts tension on the upper subpanels to frictionally brace them in face-to-face contact.

By varying the position along the length of the tongues 53, 54 at which the staples are positioned and by varying the score lines 57, 58, there may be selected the desired degree of tension applied as a biasing holding force.

Furthermore, downward pressure on slanting lower subpanel 23 will increase the bracing tension, not disrupt the same as with prior art glued or expensive tongue and groove connections.

The panelboard stock of paper or paper-plastic laminate may therefore be formed from a very thin material, since no edge or projection thereof is used as a panel end stop abutment.

Additionally, the folded-over flats shown in FIG. 2A are bound folded together for shipping purposes. And no gluing or other difficult operation need be performed after the printing and die cutting, such as is required for gluing after printing, hence avoiding the extra steps used in the prior art.

The angle B forms an implement pocket, such as is shown at 99 for receiving a writing instrument or other tool.

Figure 9:
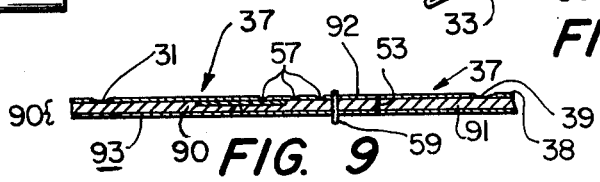
FIG. 9 is an enlarged fragmentary cross-sectional view taken on the line 9—9 of FIG. 6.

In the blown-up showning of FIG. 9 the preferred thin compressible stock 90 is formed of a compressible core 91 of paper and opposite facing layers 92 and 93 of plastic for fanciful appearance, with die cuts for the tongues being shown at 53, the compressed bend lines 57 and the staple 59 also being shown. Instead of having the mating coacting means formed as heretofore shown and described, the modified easel 30 structure of FIG. 5 and 6 may be utilized wherein projections 84, 84 of small width relative to the bracing contact surface 78 coact with small slots 86, 86 preferably curved on one side, formed in lower front subpanel 33. There is a bend line 35 formed between it and the upper front panel 34. As in the first modification, there is illustrated a bend line 31 between the first upper subpanel 34 and a second, rear vertical upper subpanel 37.

The tongues are cut out as above leaving gaps 62, 62 corresponding to gaps 61, 61.

Figure 6:
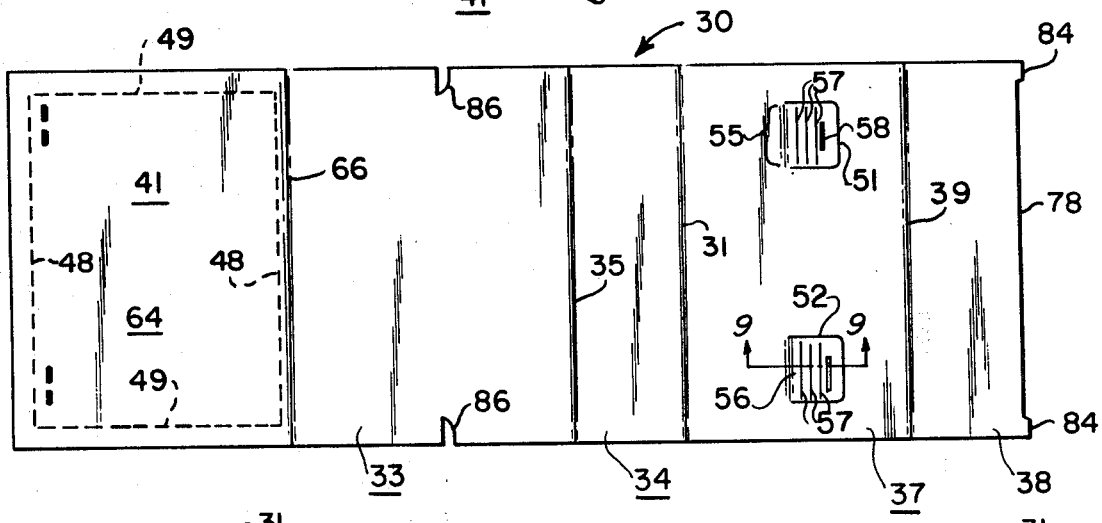
FIG. 6 is a top view of a flat blank which has been die scored, printed and is ready for folding and stapling for shipping.
Figure 8:
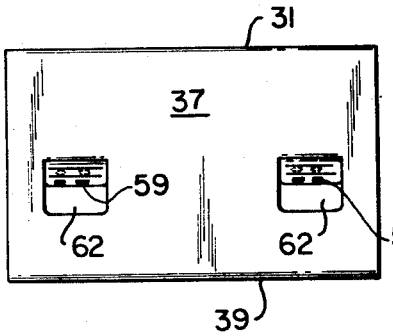
FIG. 8 is an elevational view of the back of the device when in operative position.
Figure 7:
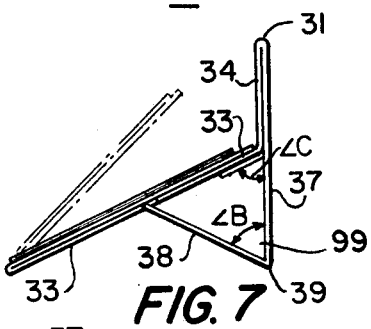
FIG. 7 is a side elevational view on a reduced scale of the structure of FIG. 5.

Additionally a separate pad carrying surface subpanel 64 having dimensions substantially preferably equal to a pad 41, as shown at 46, 46 and 47, 47 in FIG. 2 and at 48, 48 and 49, 49 may be hingedly attached to the lower edge 66 hinge line so that this entire subpanel 64 may be hingedly rotated from the position shown in FIG. 6 to those of FIGS. 5 and 7.

In this modification the staples 59 still function as selectable tension applying means, but do not perform the function of pad positioning. This latter may be accomplished by known means such as staples. The subpanel may be flipped open to use the inner surfaces as a directory or the like.

As shown at 88 and 89 in FIG. 1 and FIG. 2, the first upper subpanel 24 may be reduced in width slightly, leaving two visible side strips of surface 15,15 between edges 74,74 of subpanel 24 and edges 75,75 of subpanel 27. By this structure, used with die-cut panels, there may be used opposite color contrast, which is reversible depending on the cuts and the bending used. Also, as shown in FIGS. 1 and 5, the pads 40 and 64 may be slightly smaller than subpanels 23 or 64, leaving color contrast strips 15, 15 and 68,68 visible .

I claim:

1. A foldable easel-type mount comprising in combination:

a first panel having a width and front and rear faces, a second panel having a width substantially equal to the width of said first panel and having front and rear faces, said first and second panels being positionable in parallel planar face-to-face, flattened relation, said first panel being bendable at a first selected transverse hinge area to form a first upper subpanel having a first upper subpanel length and a first lower subpanel angularly disposed relative to said first upper subpanel and having a first lower subpanel length, said second panel being bendable at a second selected transverse area to form a second upper subpanel having a second upper subpanel length, and a lower subpanel having a second lower subpanel length and being angularly disposed relative to said second upper subpanel, means to hold said first and second upper subpanels in substantially fixed parallel planar-contacting face-to-face relation with their contacting faces being substantially unattached throughout most of the lengths thereof, a first positioning means formed on said first lower subpanel, and a second mating positioning means formed on said second lower subpanel, said first and second positioning means being adatped upon mating to hold said first and second lower subpanels substantially fixedly angularly relative to each other, and wherein said second upper subpanel has at least one bendable tongue substantially score-cut from said subpanel except at a transverse upper edge thereof, said tongue being adapted to form a portion of said holding means.

2. The combination of claim 1, wherein said bendable score-cut tongues are U-shaped and are two in number.

3. The combination of claim 2, wherein at least one of said tongues has at least one transverse bendable score line therein.

4. The combination of claim 1 wherein said subpanel holding means comprise panel penetrating means selected from the class of stitches and staples.

said panel penetrating means passing through both said first lower subpanel, at a distance spaced from said first upper subpanel and through said second upper subpanel.

5. The combination of claim 4, wherein the penetrating means comprise a plurality of staples, each of said staples passing through said first lower subpanel and through a pad positioned thereon, and also passing through at least one of said tongues formed in said second upper subpanel.

6. The combination of claim 1, wherein said first and second upper subpanels have upper edges, and said second upper subpanel is connected to said first lower subpanel by staples passed through said lower subpanel and is connected to said first upper subpanel only at the upper edges of both of said upper subpanels.

7. The combination of claim 6, wherein said second upper subpanel is longer than said upper first subpanel and has formed therein a plurality of transversely spaced, three-sided, die-cut, struck-out, bendable tongues, and wherein a selected one of said staples passes through a pad supported on said first lower subpanel and through said lower subpanel and through one of said tongues.

8. The combination of claim 7, wherein each of said tongues has at least one transverse score line and said staples pass through substantially the center of said tongues.

9. The combination of claim 8, wherein the staples form a substantially constant, initially preselectable, means for preselecting the tension between said lower subpanels when said lower subpanels are held in fixed mating angular relation, said tension means being a member of the group comprising: (a) the length of bent tongue, (b) the angle at which the tongues are bent, and (c) the position of said staples on said tongues.

10. The method of forming a multipanel slant-support easel, which comprises the sequential steps of:

forming two foldable flat overall panels hingedly connected to form at least one bendable subpanel and at least one bendable tongue portion, printing at least one side of at least one of said panels, folding said panels to position said panels in substantially face to face contact with said bendable tongue containing panel positoned beneath said other panel, positioning a pad on top of said other panel, and simultaneously stapling together said pad, said other panel and said tongue of said lower panel, whereby there is formed a folded-over two layer thick flat for shipping, which shipping flat is adaptable to be erected by relative snap lock sliding of said panels relative to each other.

* * * * *